US006279179B1

(12) United States Patent
Register

(10) Patent No.: US 6,279,179 B1
(45) Date of Patent: Aug. 28, 2001

(54) DARK-INITIATED LIQUID FLOW CONTROL CIRCUIT FOR SCRUB SINK

(76) Inventor: William J. Register, 4550 E. Hannibal St., Mesa, AZ (US) 85205

( * ) Notice: Subject to any disclaimer, the term of this patent is extended or adjusted under 35 U.S.C. 154(b) by 0 days.

(21) Appl. No.: 09/371,721

(22) Filed: Aug. 10, 1999

(51) Int. Cl.[7] ..... E03C 1/05

(52) U.S. Cl. ..... 4/623; 250/214 R; 250/221; 251/129.04

(58) Field of Search ..... 4/623, 406, 302, 4/304, 305, 313, DIG. 3; 250/206, 214 R, 214.1, 214 A, 221, 222.1; 340/565, 555, 573.1; 251/129.04

(56) References Cited

U.S. PATENT DOCUMENTS 3,505,692 * 4/1970 Forbes ..... 4/623
3,670,167 * 6/1972 Forbes ..... 250/221
3,862,414 * 1/1975 Algeri ..... 250/214 R
5,033,508 * 7/1991 Laverty, Jr., ..... 251/129.04
5,170,514 * 12/1992 Weigert ..... 4/313
5,868,311 * 2/1999 Cretu-Petra ..... 4/623

* cited by examiner

*Primary Examiner*—Henry J. Recla
*Assistant Examiner*—Tuan Nguyen

(57) ABSTRACT

A control circuit for flow control of liquid into a scrub sink wherein a differential amplifier is provided with an adjustable input signal based on the ambient condition and an input signal from a photocell which is mounted on the exterior of the edge of the scrub sink. An electrically responsive valve is in the flow line. The torso of the user contacts the photocell to initiate flow into the scrub sink

10 Claims, 2 Drawing Sheets

DARK-INITIATED LIQUID FLOW CONTROL CIRCUIT FOR SCRUB SINK

BACKGROUND OF THE INVENTION

This invention relates to a control circuit for initiating flow into a scrub sink and, in particular, to a circuit containing a photo sensitive component mounted on the scrub sink for contact with the torso of the user.

In preparation for performing a medical procedure, a doctor carefully washes his hands before placement of gloves thereon. It is necessary to complete the washing and operate the scrub sink without the use of hands so as to maintain a sterile condition. To enable the washing operation to be conducted without direct contact of the hands with the flow control mechanism or scrub sink, the combination of a light beam and photocell has been utilized. Interruption of the beam by the hands and arms of the doctor initiates flow from the spout. As long as the hands or arms continue to interrupt the beam, the flow continues. This type of device suffers from a significant disadvantage in that the doctor must continually maintain his hands in position to interrupt the beam. Since the beam width determines in part the sensitivity of the device, the use of a narrow beam is favored. Thus, the movement of the hands and/or arms during the scrubbing operation is unduly restricted else the flow of water becomes repeatedly interrupted.

Attempts to direct a beam of light to the torso of the user and monitor changes in reflected light have proven generally unsatisfactory. Changes in ambient conditions along with variations in the type of reflective surface cause the operation of the circuit to be unpredictable. Thus, the monitoring of changes in reflected light levels at or near scrub sinks has not proven satisfactory in these types of flow control devices.

Another approach has utilized an under the sink light beam and reflections sensor to detect the presence of the legs of the user. One such device is disclosed in U.S. Pat. No. 5,412,816 wherein a tubular extension is affixed under the sink for detection of the change in light level caused by the legs of the user being within a few inches of the sensor. The problems arising from changes in ambient conditions are countered by use of a short focus sensor. Thus, the doctor's movements are quite limited else the flow into the sink stops. Other under the sink approaches to providing remote actuation of flow to a scrub sink have relied on leg-actuated levers. These mechanical systems are characterized by the problems inherent in all mechanical devices subjected to repeated use. Furthermore, a doctor using this type of scrub sink actuating system is limited in movement during use since the same position is maintained to insure flow.

The present invention is directed to a dark-initiated flow control circuit which operates essentially independently of the sensitivity of a sensor and does not reply on reflected light levels for operation. The circuit utilizes a light-responsive resistive component mounted on the exterior of the edge adjacent the user. Contact by the torso or masking of the incident light causes the circuit to actuate a valve in the liquid flow line. The circuit permits adjustment for changes in ambient conditions to provide reliable operation. Further, the flow control circuit can be retrofitted on installed scrub sinks without requiring removal or alteration of the scrub sink or its tub.

SUMMARY OF THE INVENTION

In accordance with this invention, a scrub sink providing hands-free user control of the entering fluid includes an electrically-responsive valve located in the liquid flow line to control the flow of liquid through a spout in the tub of the sink.

A light-responsive component having light and dark impedance states is mounted on the exterior of the tub on the edge portion proximate to the user. The position of the cell enables the user to either rest directly against the cell or stand in close proximity thereto thereby permitting lateral movement while maintaining the cell in its dark impedance state.

The invention includes a control circuit containing a differential amplifier circuit. One input signal to the amplifier is derived through the light-responsive component, typically a photosensitive cell, with the other input signal being derived from the voltage across an adjustable resistor. The adjustment of the resistor enables the control circuit to operate under differing ambient conditions. When the user blocks incident light from the photosensitive cell, the differential amplifier provides an output which results in an actuating signal being supplied to the valve in the flow line.

The placement of the photosensitive cell and the use of the dark condition to actuate the valve enables the user to freely move the arms and hands during a scrub without experiencing interruption in flow. Further, the torso can be moved laterally without causing a cessation of flow since the photosensitive cell is considerably smaller than the torso of the user. Thus, the invention greatly enhances the mobility of the user during a scrub and facilitates the process of hands-free scrubbing.

Further features and advantages of the invention will become more readily apparent from the following detailed description of a specific embodiment of the invention when taken in conjunction with the accompanying drawings.

DESCRIPTION OF THE PREFERRED EMBODIMENT

Figure 1:
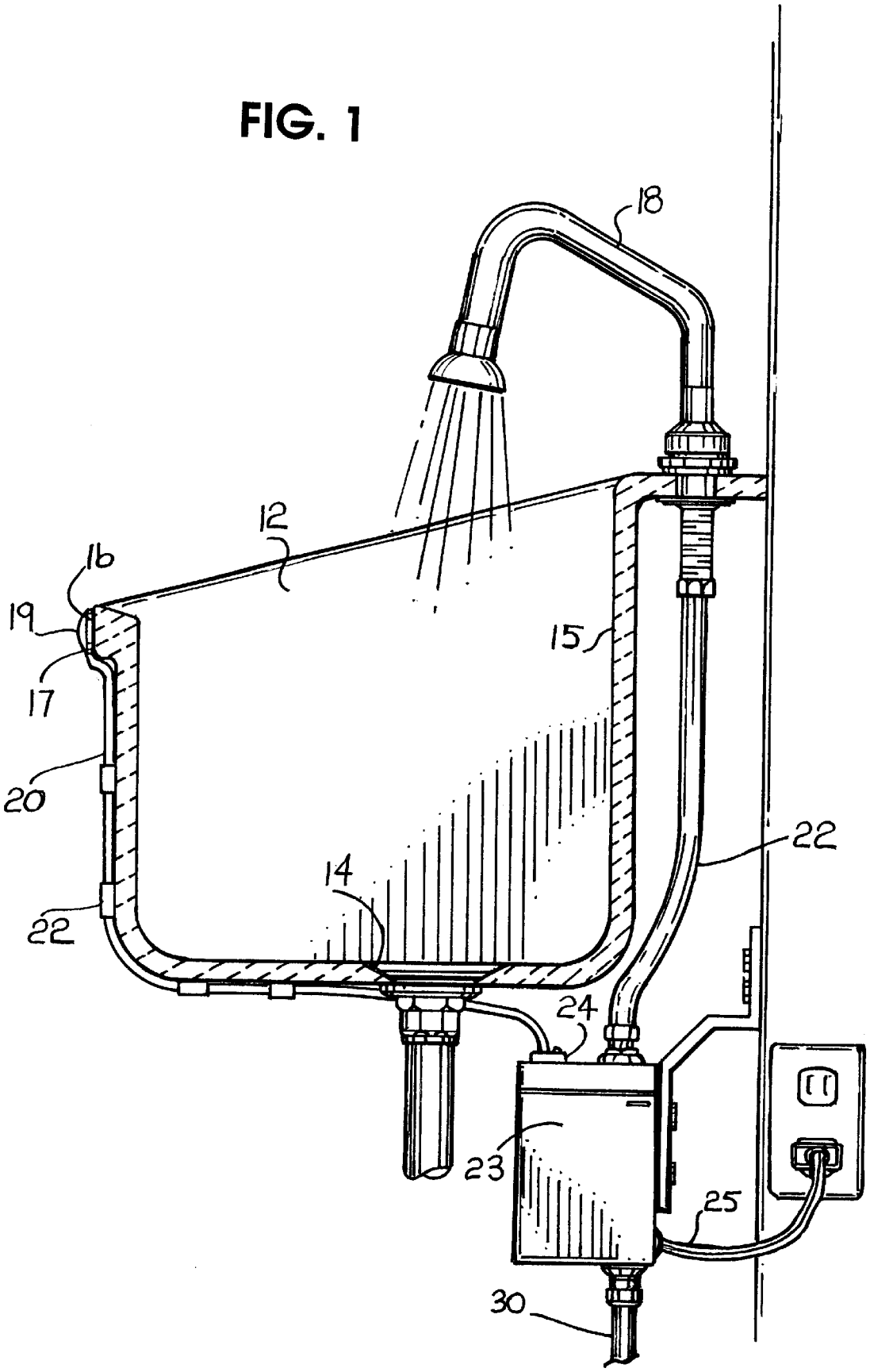
FIG. 1 is a side view in section showing a scrub sink utilizing one embodiment of the present invention.

Referring now to FIG. 1, a scrub sink is shown comprising tub 12 having a distal edge portion 15 with spout 18 extending upwardly therefrom. The proximal edge portion 16 is shown to be thicker in cross-section with a flat exterior surface. A bottom drain 14 is located in the base of the tub and coupled to the drain pipe by a conventional threaded coupler.

A light-responsive component 17 is attached to the exterior surface of proximal edge portion 16 with the translucent cover 19 facing outwardly toward the user. Attachment to the tub may be permanent by use of epoxy or removably adhered by another adhesive. The electrical connection to the control circuit housing 23 is made via cable 20 which is attached to the exterior of the tub by means of removable adhesive fasteners 22. As shown, a grommet 24 is used to provide a watertight seal in housing 23.

The housing 23 contains the electrically-responsive valve which is of conventional design and is normally a solenoid controlled valve. In the embodiment shown, the flow rate and temperature of the water flowing through flexible connector pipe 22 to spout 18 is preset. The mechanism and valving used are commercially available and are not part of the present invention. The housing 23 is inserted into the water supply circuit and the valve therein is normally closed. An electrical cable 25 extends between valve housing 23 and the electrical circuit housing 26 which is connected to the local power supply through a wall socket. The means of attachment of the scrub sink to the wall are not shown. However, it should be noted that the only modification to the scrub sink is the attachment of component 17 and the cable 20 to the exterior of the tub. The housing 23 is attached to the rigid vertical pipe 30 of the water supply and is normally supported thereby. Thus, the present invention is well-suited for use in connection with presently installed scrub sinks.

Figure 2:
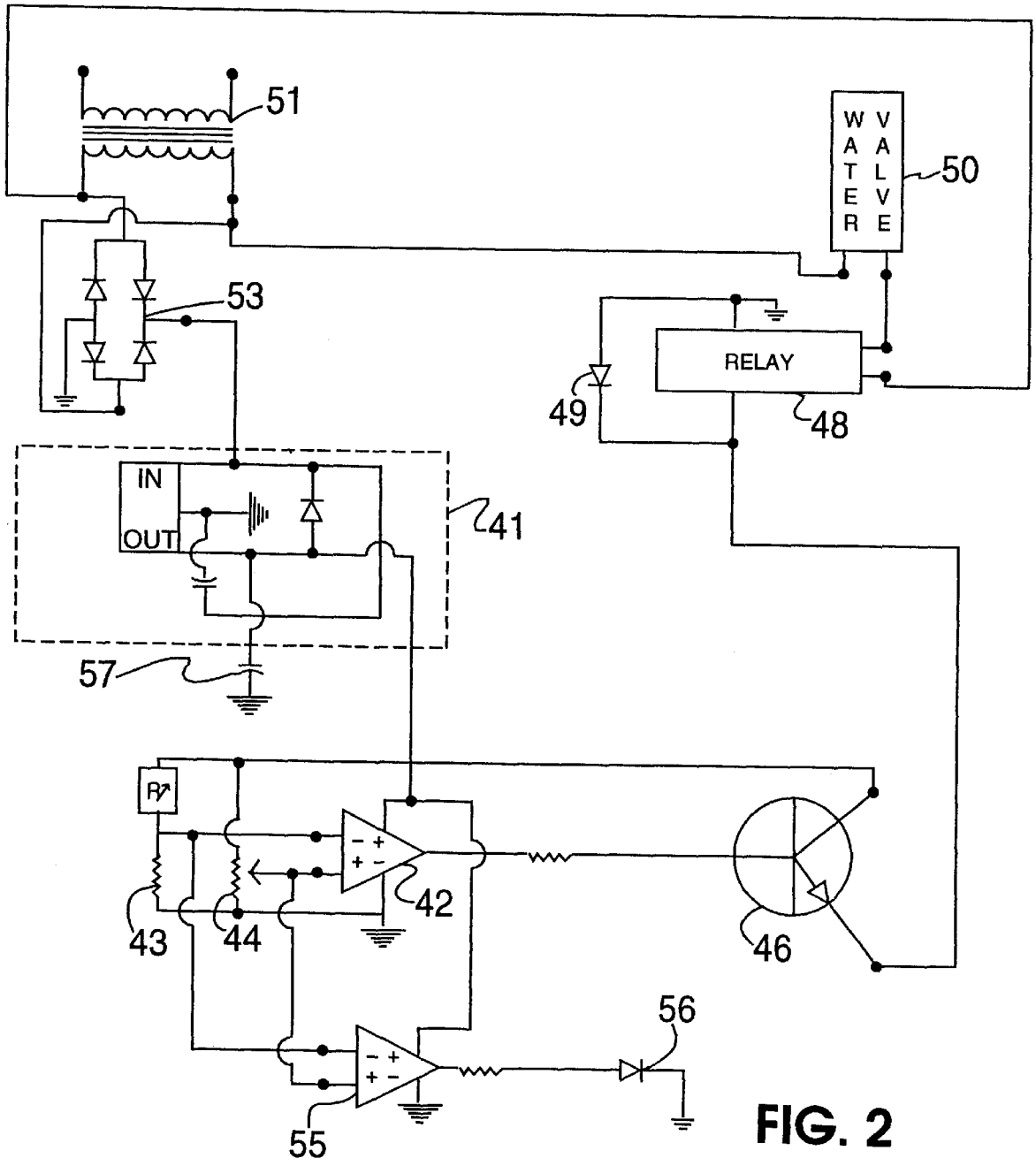
FIG. 2 is an electrical schematic of a preferred embodiment of the invention.

The electrical schematic diagram of the circuit is depicted in FIG. 2 with the photosensitive component 17 which is a commercially available cadmium sulfide photocell with light and dark resistance states of 100 and 500 k ohms respectively. The component 17 is coupled between the voltage regulator 41 and the second or minus input terminal of the differential amplifier 42. Resistor 43 couples the second input terminal to ground. A potentiometer or tapped variable resistor 44 is used to apply the reference signal to the first or positive input of the differential amplifier. The resistance establishes the baseline for the operation of the amplifier and can be changed to compensate for changes in the ambient light level.

The output terminal of amplifier 42 is supplied to the drive transistor 46. When the photosensitive component 17 enters the dark state, the output signal from amplifier 42 drives transistor 46 into conduction and a drive signal is supplied to relay 48. Relay 48 is connected in series in the low voltage circuit of step down transformer 51. The drive signal closes the normally open relay 48 to actuate the solenoid water valve 50 and permit flow through the spout into the scrub sink. A diode 49 is coupled across the relay for transient protection.

The low voltage side of transformer 51 is used to power the electrical control circuit. A bridge rectifier 53 is used to rectify the 24 volt stepped down voltage from the transformer. The rectified signal is supplied to a fixed positive 9 volt regulator 41. A ceramic capacitor 57 rated at 0.1 $\mu$f 16 v. is provided at the regulator for transient protection. The regulated output signal is provided to amplifier 42 and drive transistor 46 as well as being applied across the potentiometer 44 and the combination of photocell 17 and resistor 43. In addition, a flow indicating light-emitting-diode 56 can be utilized in the circuit. A second differential amplifier 55 is shown in FIG. 2 connected in parallel with the amplifier 42. The output signal from amplifier 55 is supplied to diode 56 for a visual indication of the condition for flow.

The transformer 51 is connected to the facility power supply and may be housed individually or in combination with the electrical control circuit. The photocell 17 and the cable thereto can be removably affixed to the exterior surface of the scrub sink thereby enabling the invention to be placed in use with presently installed scrub sinks. While the embodiment shown and described is intended for use with the water flow line to a surgical scrub sink, it should be noted that the invention can be used in other cases where hands-free fluid flow control is used. It is recognized that modifications and variations may be made in the invention as described without departing from the scope of the invention as claimed.

What I claim is:

1. A dark-initiated liquid flow control circuit wherein an electrical signal responsive valve is included in a liquid flow line, said circuit comprising:

a) a first differential amplifier having first and second input terminals and an output terminal;

b) a level-setting circuit coupled to the first input terminal for establishing a reference light level;

c) a light-responsive component having a dark impedance state, said component being coupled to be second input terminal;

d) means for coupling the level-setting circuit and the light-responsive component to a supply voltage;

e) a drive transistor coupled to said output terminal for providing an actuating signal to the valve when said component is in the dark impedance state;

f) a second differential amplifier coupled to the input terminals of the first differential amplifier for generating an indicating signal when the actuating signal is provided to the valve; and g) a light-emitting diode coupled to the second differential amplifier and responsive to the indicating signal.

2. The control circuit in accordance with claim 1 wherein said means for coupling the level-setting circuit and the light-responsive component to a supply voltage comprise:

a) a rectifier coupled to an ac supply voltage; and b) a voltage regulator to establish a dc supply voltage.

3. The control circuit in accordance with claim 2 further comprising a transformer coupled between an ac source and the rectifier.

4. The control circuit in accordance with claim 1 wherein said light-responsive component is a photocell.

5. The control circuit in accordance with claim 4 wherein said level-setting circuit includes a variable resistor.

6. The control circuit in accordance with claim 5 wherein said means for coupling the level-setting circuit and the light-responsive component to a supply voltage comprise:

a) a rectifier coupled to an ac supply voltage; and b) a voltage regulator to establish a dc supply voltage.

7. The control circuit in accordance with claim 6 further comprising a capacitor coupled to the voltage regulator for transient suppression.

8. A scrub sink of the type providing hands-free user control of liquid flow comprising:

a) a tub having proximal and distal edge portions;

b) a discharge spout coupled to a fluid flow line and spaced adjacent to the distal edge of the tub;

c) an electrically-responsive valve located in the liquid flow line to control the flow into the tub;

d) a photosensitive cell having light and dark impedance states mounted on the proximal edge portion of the tub;

e) a control circuit which includes:

i. a differential amplifier circuit having first and second input terminals and an output terminal, the photosensitive cell being connected to the second terminal, ii. an adjustable resistor connected to the first terminal, iii. a power supply connected to the photosensitive cell and the adjustable resistor, iv) a second differential amplifier coupled to the input terminals of the first differential amplifier for generating an indicating signal when the actuating signal is provided to the valve, v) a light-emitting diode coupled to the second differential amplifier and responsive to the indicating signal, and f) a relay coupled between the electrically-responsive valve and the output terminal of the differential amplifier, the placing of the photosensitive cell in the dark impedance state actuating the relay to open the valve and initiate flow.

9. The scrub sink of claim 8 wherein said photosensitive cell is mounted on the exterior surface of the proximal edge portion of said tub to facilitate contact with the user.

10. The scrub sink of claim 9 wherein said relay is open when the photosensitive cell is in the light state and further comprising a drive transistor connected to the output terminal of the differential amplifier for providing a drive signal to close the relay.

* * * * *